US005913606A

United States Patent [19]

Nicholson

[11] Patent Number: 5,913,606

[45] Date of Patent: Jun. 22, 1999

[54] BAGS

[76] Inventor: Jerome Nicholson, 275 Huntgate Cir., Apt. 304, Newport News, Va. 23606

[21] Appl. No.: 08/921,110

[22] Filed: Aug. 29, 1997

[51] Int. Cl.[6] ..... B65D 33/14; B65D 33/18

[52] U.S. Cl. ..... 383/11; 383/33; 383/62; 383/71; 220/495.08

[58] Field of Search ..... 383/11, 62, 70, 383/71, 3, 33, 35, 77; 220/404, 495.06, 495.08, 495.09, 495.11

[56] References Cited

U.S. PATENT DOCUMENTS

| | | | |
|---|---|---|---|
| 3,148,799 | 9/1964 | Meroney | 220/404 |
| 3,214,080 | 10/1965 | Wolfson | 383/11 |
| 4,009,851 | 3/1977 | Hirsch | 383/62 |
| 4,904,092 | 2/1990 | Campbell et al. | 383/35 |
| 4,906,108 | 3/1990 | Herrington et al. | 383/62 X |
| 5,014,852 | 5/1991 | Herrington et al. | 383/62 X |
| 5,040,903 | 8/1991 | Schramer | 383/71 X |
| 5,101,984 | 4/1992 | Shaw | 383/37 X |
| 5,425,468 | 6/1995 | Birkel et al. | 383/11 X |
| 5,720,557 | 2/1998 | Simonsen | 383/77 X |

FOREIGN PATENT DOCUMENTS

| | | | |
|---|---|---|---|
| 587940 | 3/1994 | European Pat. Off. | 383/62 |
| 3636109 | 5/1988 | Germany | 383/11 |
| 2173770 | 10/1986 | United Kingdom | 383/71 |

*Primary Examiner*—Jes F. Pascua
*Attorney, Agent, or Firm*—Millen, White, Zelano, & Branigan, P.C.

[57] ABSTRACT

A bag, such as a refuse bag for trash and yard waste, has at least one adhesive patch proximate the mouth of the bag so that while the bottom of the bag is resting on the ground, the top of the bag is temporarily adhered to a surface such as a wall or a tree so that the mouth the bag droops open. The adhesive patch is preferably covered with a cover strip which is stripped from the adhesive patch to expose the adhesive patch when one is ready to use the bag. The strip may be used as a tie to loop around and hold closed the top of the bag. Preferably, the bag has two, spaced adhesive patches, so that the bag can be mounted in a container, such as a trash container, with the mouth folded over and adhered to the outside of the container and so that the bag may be detached from one location and adhered at another location.

11 Claims, 3 Drawing Sheets

BAGS

FIELD OF THE INVENTION

The present invention is directed to bags. More particularly, the present invention is directed to improvements in bags, such as, for example, refuse bags.

BACKGROUND OF THE INVENTION

Bags for accumulating and storing, for at least a short period of time debris such as trash, garbage, yard waste (such as leaves and brush), and recyclable materials (such as paper and metal), preferably have configurations which make the bags convenient to use. One problem with currently available refuse bags is that they are not self-supporting. Consequently, if they are not supported by a relatively rigid structure, such as a trash can, they collapse and must be opened every time they are used. One prior art approach is to utilize a frame such as a wire frame to support the bags, but there are a number of drawbacks with such frames. For example, it is necessary to have a frame for each bag. Moreover, the frames in and of themselves are a nuisance because they are handled separately from the bags and must be stored when not in use.

Until a bag is substantially full, the mouth of the bag tends to flop over and close. In addition, one side of the mouth may fall into the other side of the mouth and, if the bag is used to collect obnoxious substances such as wet garbage from a picnic, the obnoxious substances get on the hands of the user when the user attempts to open the bag and dispose of trash and garbage. When filling bags with yard waste such as leaves and brush, it is necessary to open the mouth of the bag with one hand and then fill the bag with the leaves or brush with the other hand. This is time consuming, annoying and sloppy. There are, of course, many other reasons to have bags which do not require at least one hand to open the mouth of the bag. For example, industrial situations, where it is necessary to store and transports and articles in relatively large bags the size of trash bags, would benefit from bags which could be filled more conveniently.

SUMMARY OF THE INVENTION

The present invention is directed to improvements in bags, wherein the bags improved upon have an open mouth, a side wall and a closed bottom. In accordance with the improvement, at least one adhesive patch is placed proximate the mouth of the bag to support the bag by adhering the bag proximate its mouth to a support at a location spaced from the ground or floor.

In another aspect of the invention, the bag includes two, spaced apart, adhesive patches.

In still another aspect of the invention, the adhesive patches have cover strips thereover, wherein at least one of the cover strips is useable as a bag tie.

Upon further study of the specification and appended claims, further objects and advantages of this invention will become apparent to those skilled in the art.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
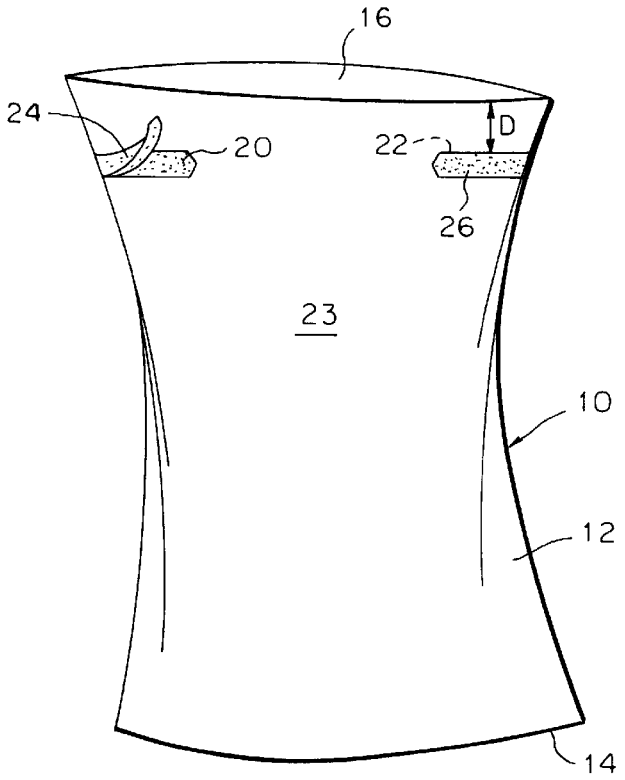
FIG. 1 is a perspective view of a bag configured in accordance with the principles of the present invention.

Referring now to FIG. 1, there is illustrated a bag 10 configured in accordance with the principles of the present invention. The bag 10 is made of a flexible plastic material, preferably the same plastic material used for trash bags currently sold at retail. The material may or may not be biodegradable. The bag 10 has a flexible side wall 12, a bottom 14 and a mouth 16. Spaced from the mouth 16, there is at least one adhesive patch 20. Preferably, there is a second adhesive patch 22 spaced from the first adhesive patch. The adhesive patches 20 and 22 are on the exterior surface 23 of the bag 10 spaced a short distance D from the mouth 16 of the bag 10. Disposed over the adhesive patches 20 and 22 are cover patches 24 and 26 which are in the illustrated embodiment in the form of strips. The cover patches 24 and 26 in the form of strips have non-adhesive surfaces which cover the adhesive patches 20 and 22, so that the adhesive patches are not exposed until the bag 10 is ready for use.

Figure 2:
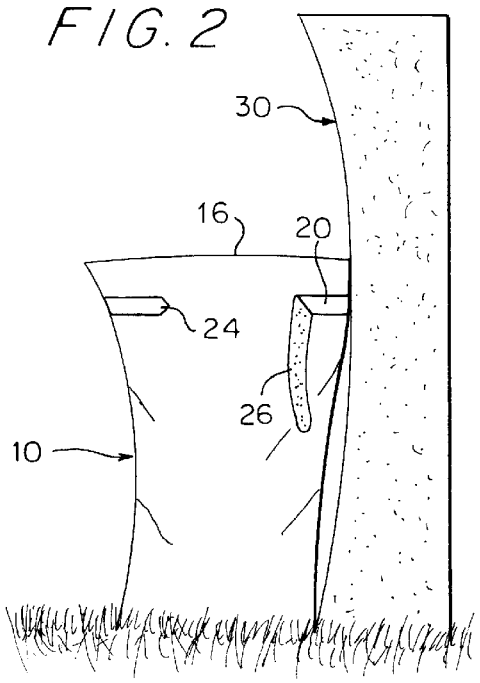
FIG. 2 is a side perspective view of the bag of FIG. 1 supported by a tree.
Figure 3:
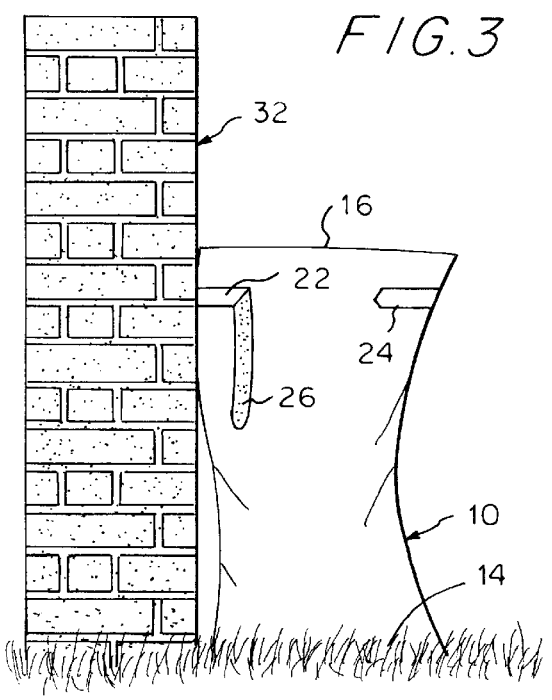
FIG. 3 is a view of the bag of FIG. 1 supported by a structure such as the side of a house or a garage.
Figure 4:
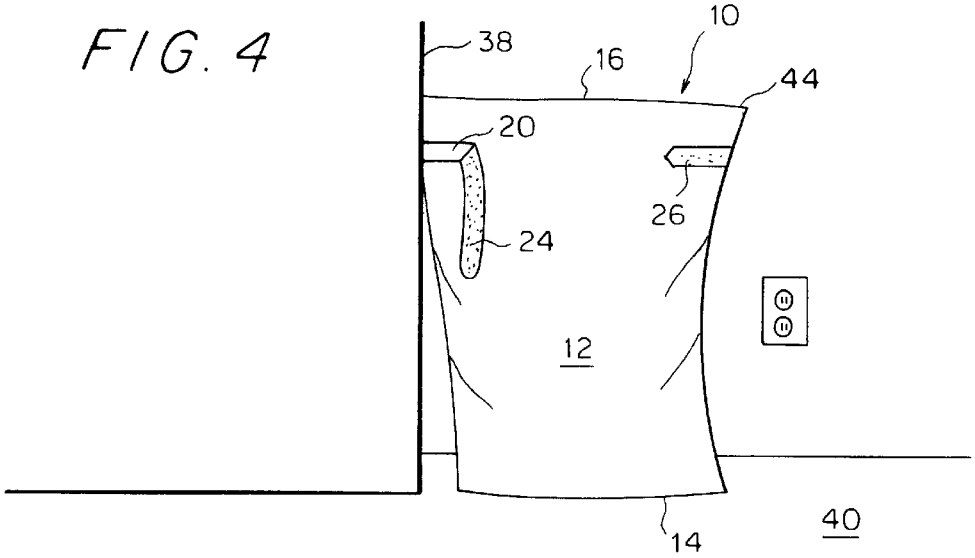
FIG. 4 is a view of the bag of FIG. 1 supported by a wall such as the interior wall of a house.

Referring now to FIGS. 2–4, the bag 10 is shown supported against various surfaces. In FIG. 2, the bag 10 is shown supported on a tree 30 and, in FIG. 3, the bag is shown supported on an exterior wall 32 of a structure such as a house or a garage. In both cases, the height of the bag 10 is such that the bottom 14 of the bag is resting on the ground 34, when the bag is attached to a tree 30 or a wall 38 by one of the adhesive patches 20 or 22. In FIG. 4, the bag 10 is shown inside of a house and adhered to a wall 38 by the adhesive patch 20 with the bottom 14 of the bag resting on a floor 40. If it is desired to move the bag 10 to another location, the adhesive patch 22 may be used to support the mouth 16 of the bag. In each of these situations, one side of the bag 10 is supported by the adhesive bond on an upright structure such as the tree 30, or the walls 32 and 38 with the bottom of the bag resting on a horizontal surface such as the ground 34 or the floor 40. The opposite side 42 of the bag droops so that the mouth 16 of the bag tends to be open. Accordingly, one need not pull the bag 10 to the upright position in order to stuff the bag, since the bag is already lifted to an upright position.

In that the bottom 14 of the bag 10 rests on the ground 34 or the floor 40, the adhesive strips 20 or 22 need only be strong enough to support the bag itself and not the bag, plus its contents. Preferably, the bag is of a substantial height of approximately 2½ to approximately 4 feet with a preferably height being about 3½ feet, so that it can be conveniently filled without the person having to bend or stoop. In essence, the floor 40 or ground 32 provide a first surface which is horizontal, while the walls 32 and 38 and tree 30 provide a second surface having at least a portion spaced vertically from the horizontal surfaces provided by the floor or ground. These portions identified by reference numerals 44, 45 and 46 provide attachment locations for the adhesive patches 20 and 22 of the bag 10.

Figure 5:
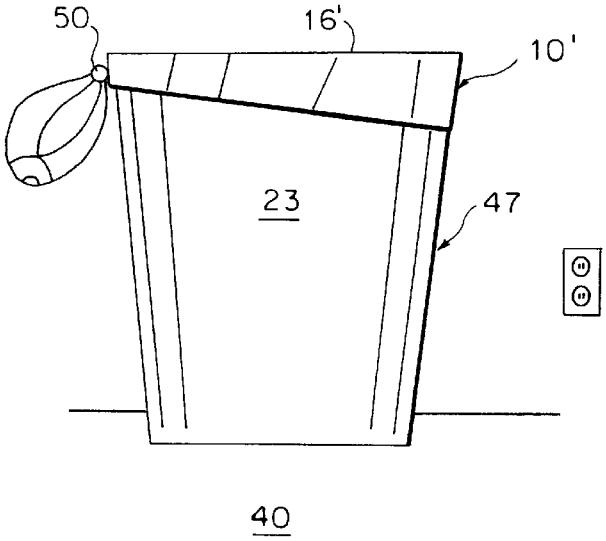
FIG. 5 is a view of trash bags mounted in a container in accordance with prior art practices.
Figure 6:
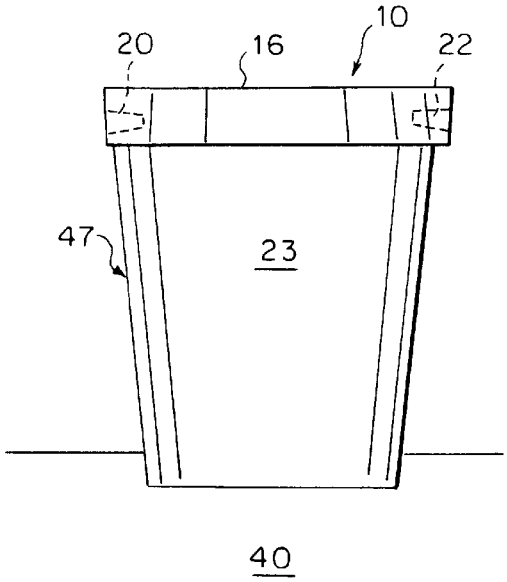
FIG. 6 is a side view of trash bags according to the present invention mounted in a container.

Referring now to FIGS. 5 and 6, there is shown another arrangement or combination utilizing the bag 10. In FIG. 5, a prior art arrangement is shown wherein, in order to keep the mouth 16' of a prior art trash bag 10' open and to keep the bag from falling into trash can 47, it is often necessary to tie a knot 50 in the bag proximate the mouth of the bag. It has been found that the knot does not always work. When using the bag 10 of the present invention, the adhesive patches 20 and 22 on the outside surface 23 of the trash can 47 by folding the mouth 16 of the bag over the rim of the trash can. Since the adhesive patches 20 and 22 release readily upon pulling the mouth 16 of the bag 10 away from the surface 23 of the trash can 47, the mouth 16 of the bag is readily closable when the bag is full. The trash can 47 is exemplary of any free standing container having a depth sufficient to accommodate the height of the bag 10.

Figure 7:
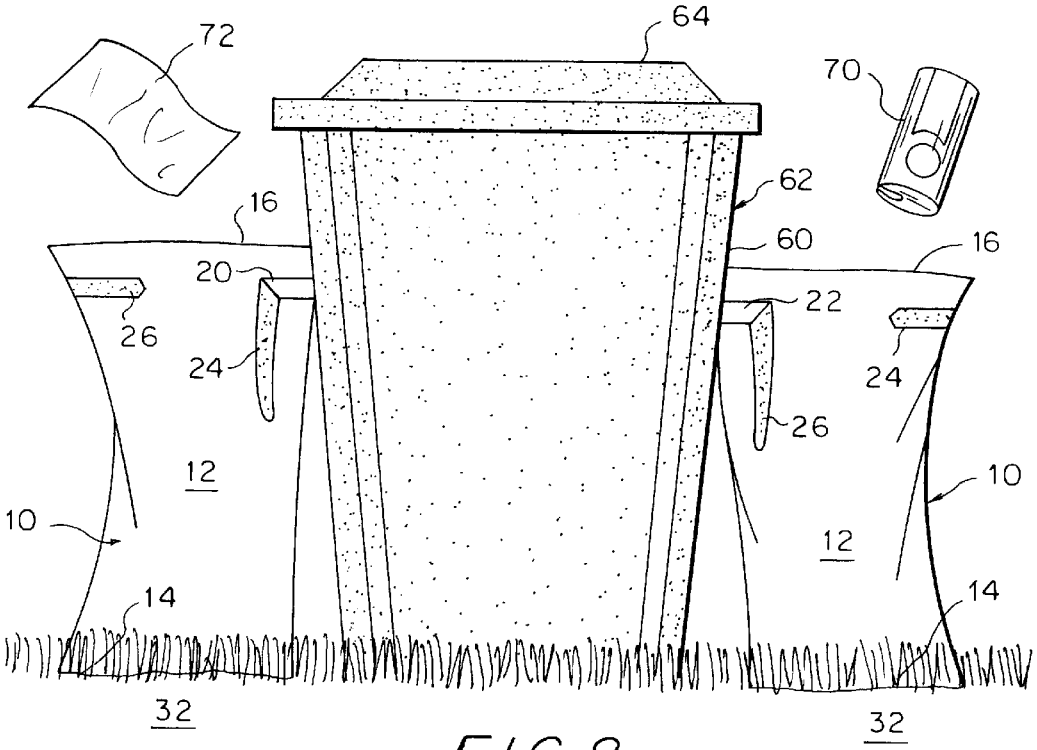
FIG. 7 is a perspective view showing the trash bags being used in combination with a regular trash can for recycling.

Referring now to FIG. 7, there is shown an additional use for the bag 10, wherein the bag is adhered to the outer surface 60 of an outside trash can 62. The outside trash can 62 contains trash in the form of garbage and, therefore, has a lid 64. Recyclable waste such as aluminum cans and paper may be appropriate placed in plastic bags since they have no food value and animals will not rip open the bags. Accordingly, one bag 10 receives cans 70 and another bag 10 receives paper refuse 72. The bags 10 are readily detachable from the can 62 because the adhesive patches 20 and 22 release readily upon pulling the mouth of the bag away from the trash container.

Figure 8:
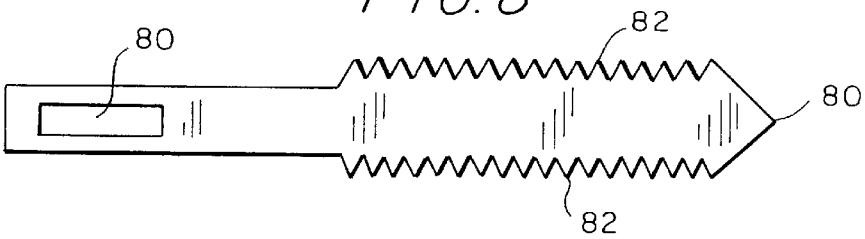
FIG. 8 is an enlarged view of the front of a cover strip used as a tie to close the top of a filled bag in accordance with the present invention.
Figure 9:
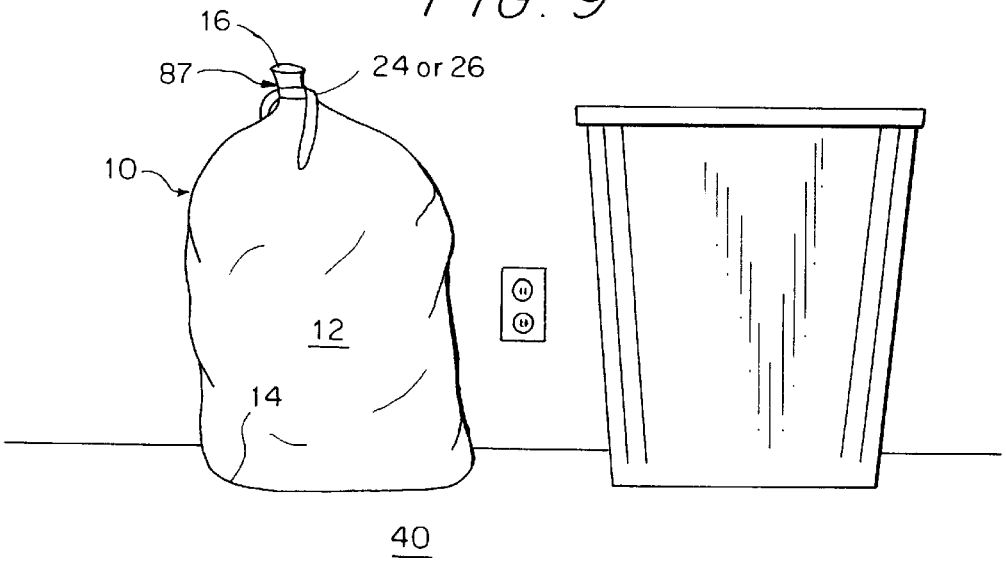
FIG. 9 is a perspective view of a bag in accordance with the present invention tied by the cover strip of FIG. 8.

Referring now to FIGS. 8 and 9, it is seen that in one embodiment of the invention, at least one of the patches 26 or 24 is configured as an elongated strip which function as a tie for tying the mouth 16 of the bag 10 closed. When configured as a tie, the covering patch 24 or 26 is a strip which has a slot 80, an end 82 which is preferably pointed, and serrated edges 84 and 86. The serrated edges 84 and 86 lock with the aperture 80 when the cover strip 24 or 26 is removed from the bag 10, or otherwise oriented so that the end 82 can be inserted into the slot 80. The serrated edges 84 and 86 then engage the edges of the slot to hold the strip in a loop around the mouth 16 of the bag 10, as is seen in FIG. 9.

The mouth 16 when closed forms a neck 87 of an outside diameter substantially smaller than the open mouth 16 of the bag. The patch 24 or 26 has a geometry and area greater than the adhesive area defined by adhesive patches 20 and 22 so as to cover these adhesive areas when placed thereover and defines a length greater than the diameter of the neck 87 of the bag, so as to surround the neck to hold the neck closed when positioned around the neck.

Bag 10 is convenient to use as a trash bag for picnics and parties, thus eliminating trash cans, and for yard work because the wind will not blow the bag away. The bag is also useful inside of a home or office or industrial facility because it can be placed in any location. Preferably, the adhesive is an adhesive similar to the adhesive of Scotch LONG MASK® masking tape No. 2090, which will adhere strongly to just about any surface without damaging the surface when it is removed.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In combination:

a bag of flexible plastic material having an open mouth at one end and closed bottom, the bag including an adhesive area adjacent the open mouth and a neck formed adjacent the mouth when the bag is closed;

a first surface providing a substantially horizontal surface upon which the bottom of the bag rests;

a second surface having at least a portion displaced vertically from the horizontal surface to which the portion the adhesive area is temporarily adhered, the portion being displaced by a distance slightly less than the height of the bag, whereby, as the bas is filled with material, force due to the weight of the material is substantially assumed by the horizontal surface and not by the adhesive area, while the adhesive area elevates the mouth of the bag for convenient filling of the bag; and a cover patch secured adjacent the open mouth having a non-adhesive exterior surface and having an area and shape covering the adhesive area when in place thereover, the area and shape of the cover patch defining a length greater than the diameter of the neck of the bag and surrounding the neck to hold the neck closed when positioned theraround.

2. The combination of claim 1, wherein the second surface is a wall and the horizontal surface is a floor.

3. The combination of claim 1, wherein the second surface is a wall and the horizontal surface is the ground.

4. The combination of claim 1, wherein the second surface is on a tree and the horizontal surface is the ground.

5. The combination of claim 1, wherein the second surface is on a trash can and the horizontal surface is the ground whereby the bag serves as a container for recyclables.

6. The combination of claim 5 further including an additional bag resting on the ground and having an adhesive area securing the bag to the trash container in the same way as the previously recited bag, wherein the bags are for containing separate recyclable materials.

7. The combination of claim 1 further including the cover patch being an elongated strip for covering the adhesive area when the adhesive area is not being used to attach the bag to the second surface.

8. The combination of claim 7, wherein the covering strip has a length greater than the diameter of the neck to form a loop for surrounding and closing the mouth of the bag when the bag is full.

9. In combination, a free-standing container having a side wall with an exterior surface and a mouth;

a bag having a wall defining an enclosure with an open mouth at one end of the enclosore;

a plurality of adhesive areas on the exterior surface of the bag, wherein the bag is removably placed within the container with the adhesive areas releasably engaging the exterior surface of the container adjacent the mouth of the container to keep the bag from sliding into the container; and a cover patch secured adjacent the open mouth having a non-adhesive exterior surface and having an area and shape covering at least one of the adhesive areas when in place thereover, the area and shape of the cover patch defining a length greater than the diameter of a neck formed on the bag adjacent the mouth when the bag is closed and surrounding the neck to hold the neck closed when positioned therearound.

10. The combination of claim 9, wherein the cover patch is an elongated strip, having a length sufficient to serve as a tie for securing the mouth of the bag closed when the bag is filled with material by wrapping around the neck.

11. The combination of claim 9, wherein there is a cover patch over each adhesive.

* * * * *